US006929128B2

(12) United States Patent
Caldwell et al.

(10) Patent No.: US 6,929,128 B2
(45) Date of Patent: Aug. 16, 2005

(54) PRODUCT SAMPLER PACKET ASSEMBLY WITH ENHANCED BURST STRENGTH AND METHOD OF MANUFACTURE

(75) Inventors: Kimberly M. Caldwell, Camillus, NY (US); Dale Betts, Marathon, NY (US); Richard Bloom, Ithaca, NY (US); Charles Card, Cortland, NY (US); Robert Chichester, Millington, NJ (US); Ronald DeMeo, Morristown, NJ (US); David Hempson, Cortland, NY (US); Chris Maxson, Cortland, NY (US)

(73) Assignee: Marietta Corporation, Cortland, NY (US)

( * ) Notice: Subject to any disclaimer, the term of this patent is extended or adjusted under 35 U.S.C. 154(b) by 0 days.

(21) Appl. No.: 10/460,838

(22) Filed: Jun. 12, 2003

(65) Prior Publication Data

US 2005/0011794 A1 Jan. 20, 2005

(51) Int. Cl.[7] ..... B65D 73/00
(52) U.S. Cl. ..... 206/466; 206/484; 206/734
(58) Field of Search ..... 206/466, 469, 206/732, 734, 813, 484, 484.1

(56) References Cited

U.S. PATENT DOCUMENTS

| | | | | | |
|---|---|---|---|---|---|
| 4,923,063 | A | * | 5/1990 | Tararuj | 206/484 |
| 4,941,574 | A | * | 7/1990 | Meehan | 206/466 |
| 5,535,885 | A | * | 7/1996 | Daniel et al. | 206/484 |
| 5,879,769 | A | * | 3/1999 | Greenland et al. | 428/35.7 |
| 6,301,860 | B1 | * | 10/2001 | Gunderman et al. | 53/410 |
| 6,688,467 | B2 | * | 2/2004 | Krupka et al. | 206/469 |
| 6,749,229 | B2 | * | 6/2004 | Kennedy | 283/56 |

* cited by examiner

*Primary Examiner*—John A. Ricci
(74) *Attorney, Agent, or Firm*—Brian B. Shaw, Esq.; Stephen B. Salai, Esq.; Harter, Secrest & Emery LLP

(57) ABSTRACT

A product sampler packet assembly includes a flexible packet bonded to a carrier card by an adhesive standoff having sufficient hardness (and resistance to creep) to increase the burst strength of the assembly above that of the packet alone. The adhesive standoff is disposed between the packet and the carrier card to define a well into which the packet is at least slightly deformed under compression such that the adhesive stand off distributes the compressive force without substantial transfer to the closure seal of the packet.

23 Claims, 5 Drawing Sheets

PRODUCT SAMPLER PACKET ASSEMBLY WITH ENHANCED BURST STRENGTH AND METHOD OF MANUFACTURE

CROSS-REFERENCE TO RELATED APPLICATIONS

Not Applicable.

STATEMENT REGARDING FEDERALLY SPONSORED RESEARCH OR DEVELOPMENT

Not applicable

REFERENCE TO A "SEQUENCE LISTING"

Not applicable.

BACKGROUND OF THE INVENTION

1. Field of the Invention

The present invention relates to a product sampler packet assembly for sampling purposes as well as for insertion in magazines, catalogs, and periodicals delivered to consumers, and more particularly to a packet assembly with an adhesive bond between a packet and a carrier card to provide an enhanced burst strength of the assembly.

2. Background Art

Manufacturers of cosmetics, toiletries, beauty and skin-care products commonly promote their products by distributing free samples to current or potential consumers with the goal of building and/or maintaining customer loyalty for the products or product lines. Typically, each sample is packaged in a disposable sampler package which is generally sized to contain approximately one unit dose of the product in an attractive display having artwork or informational copy printed thereon. A sampler package having these aesthetic features will encourage the potential customer to sample the product and enable the consumer to experience a product.

One method of distributing sample packages to potential customers is in a store in which the product is sold. However, a further reaching, more effective method has been to mail the sampler package to a targeted audience through the U.S. Postal Service (USPS). Typically, the sampler packages are mailed as inserts in periodicals, brochures, catalogs, magazines, or the like.

For distribution through the USPS, the sampler packages can be mailed either under a non-discounted rate classification or under a more economical periodical/subscription rate classification. To qualify for the periodicals/subscription rate, each sampler package must comply with certain guidelines set by the USPS. For example, the sampler package must be firmly affixed to a carrier card or to a page of the periodical, and designed to allow the product to be sampled while remaining affixed in the periodical. Sampler packages for distribution as inserts must also be non-bulky and sufficiently flexible to avoid breakage in shipment or storage.

When the product to be sampled is a fluid and/or volatile composition such as a liquid, creme, lotions, color cosmetics, gel or paste, bindery and distribution environments typically require that the sampler package must also be capable of withstanding the substantial compression forces exerted on the sampler package when inserted in periodicals, such as magazines, brochures or catalogs, which are then stacked for storage or distribution.

In one type of prior art sampler package as disclosed in U.S. Pat. No. 5,535,885 to Daniel et al., a liquid fragrance sample is disposed in a container made of gelatin which is designed to distribute compressive forces away from the portion of the container retaining the sample so as to avoid rupture during shipment or storage. This container, however, provides thickened edges surrounding the sample-containing portion, and also concentrates the volume of the sample into a cylindrical central region. When the disclosed sampler packages are placed as inserts in a stack of magazines or the like, the stack becomes cumulatively bulky due to the significant thickness of the disclosed sampler package, thus creating a "footballing" effect in the stack of magazines.

Another sampler package as disclosed in Meehan, U.S. Pat. No. 4,941,574, provides a sampler for a liquid product contained in a flexible envelope made from a film material. The sampler package is protected from bursting by sandwiching the edges of the envelope between two layers of a rigid material having a combined thickness at least that of the envelope having the product contained therein. To sample the product, however, one must detach the envelope from the rigid layers, rather than simply opening and testing the product while still affixed in the package.

A further attempt to meet the USPS regulations is shown in U.S. Pat. No. 6,301,860 to Gunderman. The Gunderman patent employs a planar support frame for surrounding a portion of the filled sampler package.

In view of the prior art discussed above, the need exists for a sampler packet assembly designed for distribution as an insert in subscription rate periodical literature, wherein the assembly has enhanced burst strength, allows a consumer to test or sample the product with the sampler remaining affixed to the carrier medium, and is substantially flat or non-bulky to avoid a cumulative "footballing" effect. The need also exists for a sample packet assembly that has reduced components, thereby reducing weight and cost.

BRIEF SUMMARY OF THE INVENTION

The present invention provides a product sampler packet assembly containing a product sample, wherein the packet assembly can be inserted into periodicals in a manner which satisfies the requirements for subscription rate classification as set by the U.S. Postal Service, as well as bindery and distribution requirements of the periodicals. As used herein, the term "periodical" encompasses magazines, journals, publications, brochures, prints and flyers.

The present invention also provides a product sampler packet assembly containing a fluid, gel, powder, paste or volatile product, wherein the assembly can be inserted in periodical literature such that the product can be extracted from the packet with the packet is still affixed to a carrier card.

The present invention further provides a product sampler packet assembly which is relatively non-bulky so as to minimize any "footballing" effect when distributed as inserts in magazines or other periodicals which may be stacked on top of one another.

Further, the present invention provides a product sampler packet assembly for fluid, gel, paste or powder products, wherein the burst strength of the assembly is substantially greater than a burst strength of the packet.

The product sampler packet assembly includes a flexible packet bonded to a carrier card by an adhesive standoff, wherein the adhesive standoff and carrier card form a shallow well. The product sampler packet, containing the product sample, is positioned on the adhesive standoff and affixed to the carrier card so as to be at least partially disposed within the well.

The packet assembly is suitable for rapid insertion or binding into a periodical, catalog, brochure, or other literature. The packet allows the retained product to be tested while remaining affixed to the carrier card (or page in the periodical), and protected by the surrounding presence of the adhesive standoff to absorb compressive forces.

BRIEF DESCRIPTION OF THE SEVERAL VIEWS OF THE DRAWING(S)

DETAILED DESCRIPTION OF THE INVENTION

Figure 4:
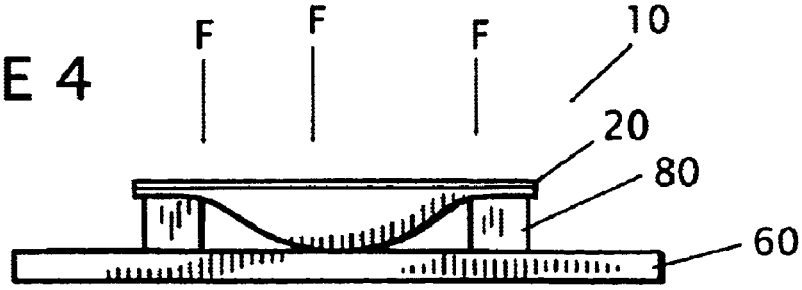
FIG. 4 is a side elevational view of the packet assembly.
Figure 5:
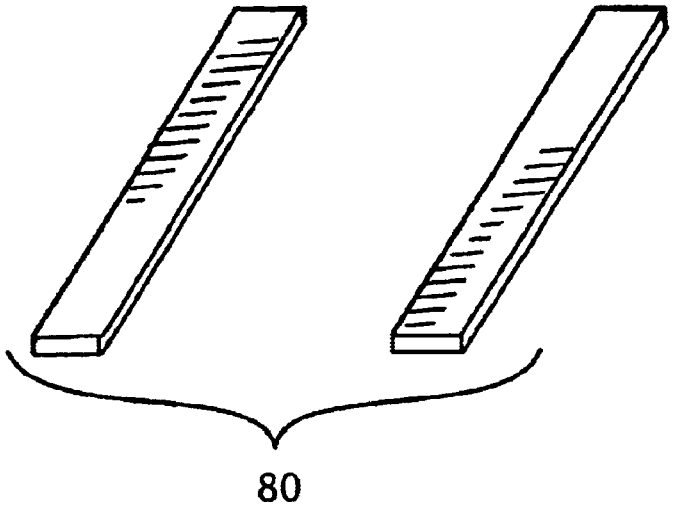
FIG. 5 is a perspective view of an adhesive standoff configuration.
Figure 6:
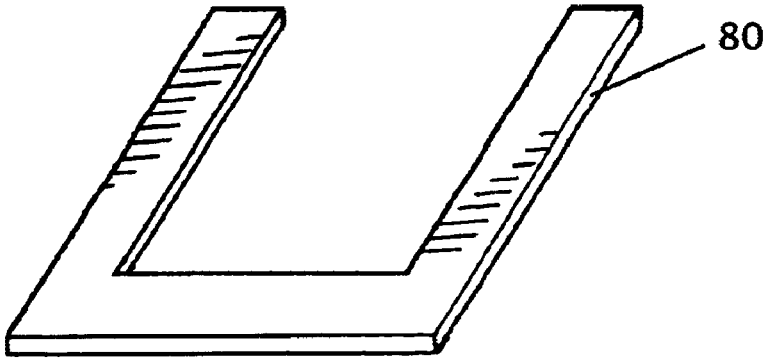
FIG. 6 is a perspective view of an alternative adhesive standoff configuration.
Figure 7:
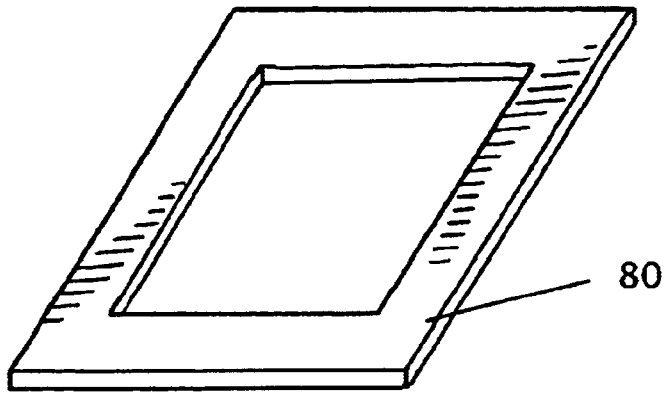
FIG. 7 is a perspective view of another adhesive standoff configuration.
Figure 8:
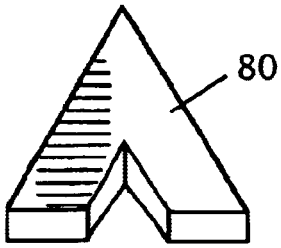
FIG. 8 is a perspective view of a further adhesive standoff configuration.
Figure 8:
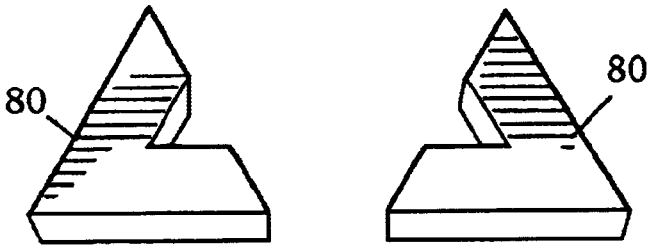
Figure 9:
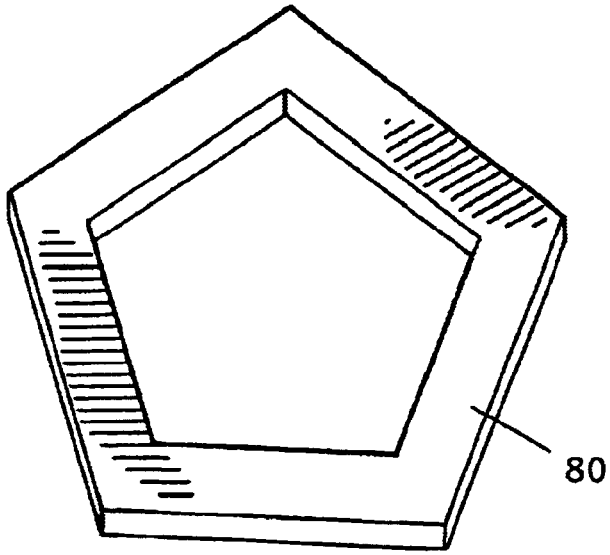
FIG. 9 is another alternative adhesive standoff configuration.
Figure 10:
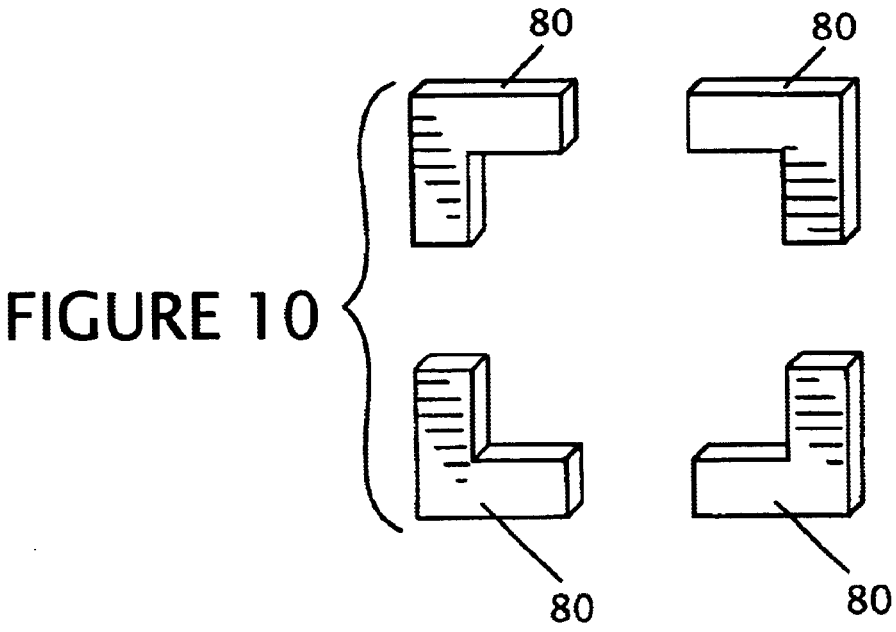
FIG. 10 is a perspective view of an additional adhesive standoff configuration.

Referring to FIG. 4, the product sampler packet assembly 10 includes a packet 20, a carrier card 60 and an adhesive standoff 80 bonding the packet to the carrier card.

The carrier card 60 can be any of a variety of materials or configurations but is typically sized for insertion or binding into a periodical. The carrier card 60 can be made of stock paper or paper board, as well as laminate. It is also contemplated, the carrier card 60 can be formed of polymeric impregnated or augmented materials. Available constructions of the carrier card 60 include composite laminates.

The packet 20 retains the product to be sampled. The packet 20 is a flexible pouch or container, having a generally flat planar profile defining a sealed volume V. The packet 20 can be configured to retain any of a variety of materials including liquids, gels, as well as dry or power materials. Thus, a spectrum of products such as lotions, creams, moisturizers, ointments and balms can be retained in the packet 20.

Figure 3:
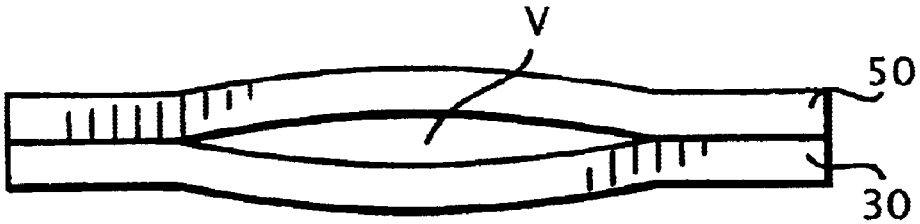
FIG. 3 is a cross sectional view taken along lines 3—3 of FIG. 1.

As seen in FIG. 3, the packet 20 is formed of a lower layer 30 and an upper layer 40 which are bonded together to retain the product. The upper and lower layers 50,30 are typically formed of a flexible sheet material such as a laminate or foil. The layers 50,30 are selected and constructed to be impervious to the product. The laminates may include metallic layers, moisture barrier layers, as well as polymeric layers. In addition, it is contemplated the upper and lower layers 50,30 may include transparent or translucent areas so that the retained product can be viewed prior to opening the packet 20. The upper and lower layers 50,30 can be formed of the same or different laminates or foils, depending upon the product and the intended application.

The upper layer 50 is bonded to the lower layer 30 along a peelable interface, thereby allowing a user to selectively access the product from the packet 20. Further, as described in terms of the adhesive, the lower layer 30 is permanently affixed to the carrier 60 such that upon opening of the packet 20, at least the lower layer of the packet remains affixed to the carrier card.

The upper and lower layers 50,30 can be bonded to define a dispensing spout 22. Typically, the spout 22 can be defined by the seal lines between the upper and lower layers. The areas of bonding between the upper layer 50 and the lower layer 30 are selected to provide a locally peelable connection between the layers, while limiting the amount of separation of the layers. That is, the layers 30,50 are allowed to separate in generally predefined areas, without completely separating the layers. The opening of the packet 20 can be provided by cheverons, laser scores, or corner or thumb tabs. Typical adhesives for bonding the upper layer to the lower layer to provide the peelable construction have a burst strength of less than approximately 250 pounds over 30 seconds.

As contemplated, the upper and lower layers 50,30 can be bonded together to define the periphery of the packet volume V. Alternatively, the upper and lower layers 50,30 can be formed from a contiguous piece of material, wherein a fold line such as a bottom fold connects the upper and lower layers along one edge of the packet 20.

In one configuration, the upper layer 50 peels from the lower layer 30, such that the spout 22 (or access to the product) is formed within the periphery of the lower layer. That is, as product is dispensed from the packet 20, the product is located on an exposed area of the lower layer 30. Thus, the product is not dispensed onto the carrier card 60. By locating the dispensed product on the lower layer 30, the risk of absorbing dyes or other contaminants in the product is reduced.

Figure 1:
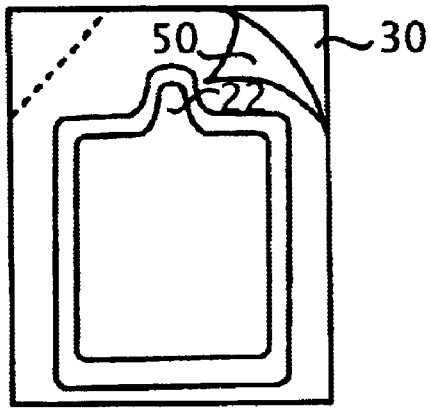
FIG. 1 is a top plan view of a packet having a first peelable opening configuration.
Figure 2:
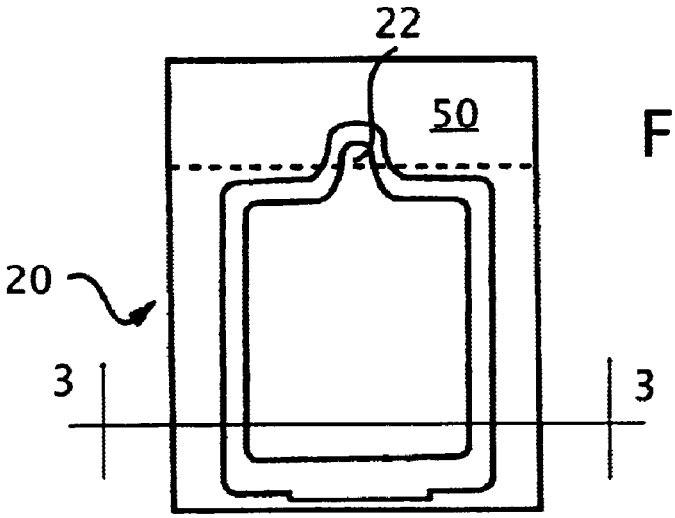
FIG. 2 is a top plan view of an alternative packet construction having a different second peelable opening configuration.

The packet 20 can have any of a variety of periphery configurations such as curvilinear, or multifaceted, including triangular, rectangular. Referring to FIGS. 1 and 2, a suitable periphery has been found to be a rectangular form between approximately 1¾ inches to 2½ inches by 1¾ inches by 2½ inches, with a more preferred size of approximately 2 inches by 2¼ inches with a more preferred size of 1 15/16 inches by 2¼ inches.

In compliance with current postal regulations, the packet 20 is sized to retain no more than 0.35 grams of the product. Depending upon the density (specific gravity) of the product, the packet thus defines a volume of approximately 0.35 cc.

Typical laminates for the upper and lower layers 50,30 include 48 gauge PET/white Low Density Polyethylene (WLDPE)/0.00035 foil with adhesives, wherein the layers are bonded by 2 mil of easy peel sealant, such laminates are distributed by Curwood. However, both laminates of (i) 48 gauge PET/WH/.0003 Foil/EAA with 2 mil adhesive from Glenroy and (ii) 48 gauge PET/adhesive/.0003 foil with 1.74 mil peelable polyethylene from Tobepal have been found satisfactory.

It is also believed (i) 48 gauge PET/WLDPE/35 gauge foil/48 gauge PET with 2 mil peelable seal (Integra peel)

from Rexham; (ii) 48 gauge PET/LDPE/0.00035/foil/LDPE/2.17 mil peelable sealant layer from Tolas and (iii) 48 gauge PETIWPE/0.00035/0.002" peelable seal (Allegro) from Rollprint are believed to be satisfactory.

It is understood that other gauges of PET or paper can be employed for the layers 30,50. In addition, oriented polypropylene (OPP) can be substituted for the foil. Exemplary clear materials include 48 gauge PET/aluminum oxide with peelable sealant, as well as combinations including PET, OPP, Barex, polyethylene, nylon, polypropylene, polyvinyl chloride and PVDC can be employed.

As seen in FIG. 4, the adhesive standoff 80 bonds the packet 20 to the carrier card 60, and more specifically, the lower layer 30 of the packet to the carrier card.

Figure 11:
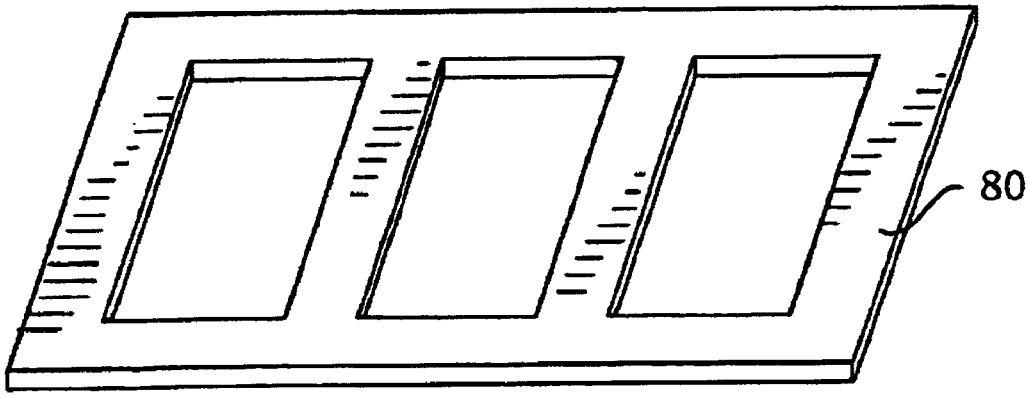
FIG. 11 is a perspective view of an available adhesive standoff configuration.
Figure 12:
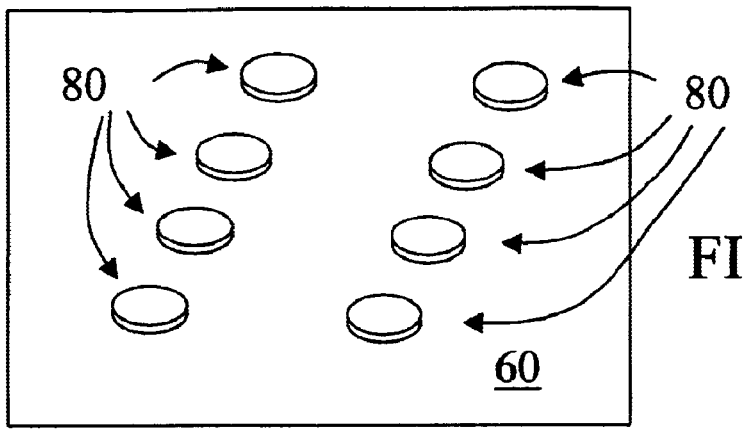
FIG. 12 is a perspective view of an adhesive standoff having a plurality of discrete posts.
Figure 13:
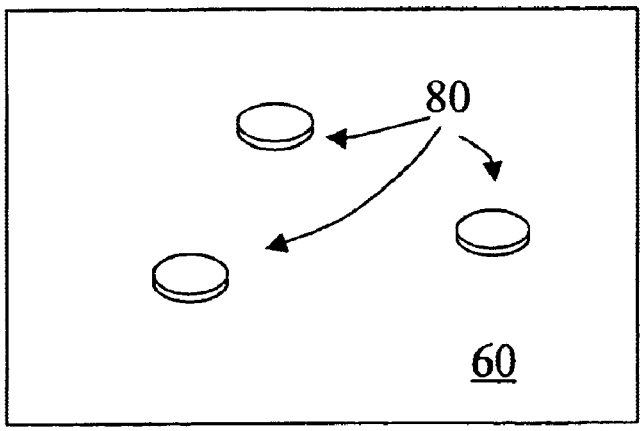
FIG. 13 is a perspective view of an alternative configuration of the adhesive standoff having a plurality of discrete posts.

The adhesive standoff 80 is preferably disposed between the packet 20 and the carrier card 60 to form a stand off of sufficient size (height) to dispose a majority of the retained product between a top of the standoff and the carrier card. Thus, the adhesive standoff 80 generally forms a well into which at least a portion of the packet 20 is at least partially deformed. The adhesive standoff 80 can be applied to the carrier card 60 (or the lower layer 30 of the packet 20) to define any of a variety of well configurations including parallel lines, a plurality of posts (or dots) shown in FIGS. 12 and 13, as well as a closed loop, including a square, circular, oval or triangle as seen in FIGS. 5–11. Referring to FIG. 11, the adhesive standoff can be a combination of parallel members, and a closed periphery to accommodate one or a plurality of packets. Thus, the adhesive standoff 80 is of sufficient size to shield or protect the packet from a compressive force that would otherwise burst the packet.

The adhesive is selected to provide sufficient rigidity so as to increase the burst strength of the packet 20 as the packet is affixed to the carrier card. It has been found, with the proper adhesive, that the burst strength of the packet 20 affixed to the adhesive standoff 80 can be as much as 3,000 lbs. for 30 seconds, as opposed to the burst strength of the packet alone being less than 250 pounds for 30 seconds.

The adhesive is selected to generally resist compressive force during the compression test and distribute the pressure along the adhesive, without imparting significant amounts of the pressure to the packet 20 and the peelable seal between the upper and lower layers 50,30 of the packet. The adhesive will only slightly deform upon compression. Thus, the adhesive forms a solid non flowing standoff which protects the packet 20 from excessive pressure in the compression test.

The adhesive is also selected to permanently bond the packet 20, and particularly the lower layer 30 of the packet, to the carrier card 60 such that upon an opening force exerted on the upper layer 50, the bond between the upper layer and the lower layer yields before the bond between the packet and the adhesive standoff 80 (or the carrier card). Preferably, the adhesive bonds to the packet 20 and the carrier card 60 to preclude non-destructive separation.

An adhesive found to be suitable is Hysol 7804 as manufactured by Loctite. This adhesive has a hardness of approximately 74 Shore A. An alternative adhesive found to be satisfactory is Hysol Coolmelt from Loctite, with a hardness of approximately 73 Shore A. Although not yet tested, it is believed the following adhesives have sufficient hardness, compressive strength and creep to provide the recited enhanced burst strength of the assembly: Uni-Melt series 3500, 3510, 3520, 3170, 3210 and 3220 by Uniplast each have a hardness of at least approximately 74 Shore A.

Satisfactory adhesive standoffs 80 have been formed by adhesives having a cured hardness greater than 70 Shore A. It is believed a Shore A hardness of at least 60 may be satisfactory, with a preferred hardness of at least 70 Shore A. The adhesive standoff 80 is formed as a pair of parallel strips from a 0.016 glue nozzle. In one configuration as seen in FIG. 4, the adhesive standoffs 80 are sized to be intermediate the bonded areas of the packet 20 and the carrier card 60.

The adhesive standoff 80 is selected such that a contact area of the standoff, a height of the standoff, hardness of the standoff, and resistance to creep of the adhesive standoff provide the assembly 10 with a greater burst strength than the packet 20 alone. Specifically, depending upon the burst strength of the packet 20, the assembly burst strength may be 2× greater than the packet, preferably 5× greater and in some configurations at least 10× greater. As it is generally desirable to have as low a peel strength as possible, it is advantageous to enhance the burst strength of the assembly 10.

Those adhesives that deform under pressure have been found unsatisfactory. These unsatisfactory adhesives typically have a hardness less than 50 Shore A.

Thus, the preferred adhesive forming the adhesive standoff 80 has a sufficiently low creep and a sufficiently large compressive strength to provide a burst strength for the packet assembly of 3,000 lbs. for 30 seconds.

It is further contemplated that a plurality of adhesives can be used to bond the packet 20 to the carrier card 60, wherein one of the adhesives is selected to provide the stand off (compression resistance) and the remaining adhesive provides performance over a desired temperature range. Specifically, it has been found that some adhesives, while having sufficient hardness to form the stand off, have reduced performance in cold temperatures. As the periodicals are mailed throughout the year, the adhesive is often subjected to temperatures below freezing. These freezing temperatures often reduce the efficacy of the adhesive. Therefore, for mailings during these reduced temperature periods, a second adhesive having an enhanced adhesion under reduced temperature can be employed in conjunction with the rigid stand off adhesive.

Therefore, the present packet assembly 10 provides an assembly burst strength that is substantially greater than a packet burst strength without requiring additional components, layers or processing steps. Thus, the assembly can be manufactured more readily and less expensively than those systems employing intermediate solid layers, in addition to prior flexible adhesives.

While the invention has been described in connection with a presently preferred embodiment thereof, those skilled in the art will recognize that many modifications and changes made be made therein without departing from the true spirit and scope of the invention, which accordingly is intended to be defined solely by the appended claims.

What is claimed is:

1. A product sampler packet assembly for distribution, the product sampler packet assembly comprising:

(a) a carrier card;

(b) a sealed packet having a top layer and a bottom layer, a portion of the top layer releasably sealed to a portion of the bottom layer, the sealed packet retaining a volume of sample material and the sealed packet having a packet burst strength; and (c) an adhesive standoff bonding the sealed packet to the carrier card to preclude non destructive separation of the packet and the carrier card, the adhesive standoff defining a well sized to receive the volume of sample material, the adhesive standoff having a hardness to provide an assembly burst strength of the packet bonded to the carrier card at least twice as great as the packet burst strength.

2. The product sampler packet assembly of claim 1, wherein a portion of the top layer is permanently sealed to the bottom layer.

3. The product sampler packet assembly of claim 1, wherein the top layer includes a laser score line of weakness.

4. The product sampler packet assembly of claim 1, wherein the top layer is contiguous with the bottom layer along a fold line.

5. The product sampler packet assembly of claim 1, wherein the adhesive standoff bonds to the carrier card to preclude non-destruction separation from the carrier card.

6. The product sampler packet assembly of claim 1, wherein the adhesive standoff includes a pair of spaced walls.

7. The product sampler packet assembly of claim 1, wherein the top layer includes a cheveron.

8. The product sampler packet assembly of claim 1, wherein the top layer includes a perforation line of weakness.

9. A product sampler packet assembly distribution, the product sampler packet assembly comprising:

(a) a carrier card;

(b) a sealed packet having a top layer and a bottom layer, a portion of the top layer releasably sealed to a portion of the bottom layer, and the sealed packet retaining a volume of sample material; and (c) an adhesive standoff bonding the sealed packet to the carrier card, the adhesive standoff defining a well sized to receive the volume of sample material, the adhesive standoff having a hardness greater than 70 Shore A.

10. A product sampler packet assembly for distribution, the product sampler packet assembly comprising:

(a) a carrier card:

(b) a sealed packet having a top layer and a bottom layer, a portion of the top layer releasably sealed to a portion of the bottom layer, the sealed packet retaining a volume of sample material and the sealed packet having a packet burst strength; and (c) an adhesive standoff bonding the sealed packet to the carrier card to preclude non destructive separation of the packet and the carrier card, the adhesive standoff defining a well sized to receive the volume of sample material, the adhesive standoff having at least one of a hardness, creep and tensile strength to provide an assembly burst strength of the packet bonded to the carrier card at least twice as great as the packet burst strength.

11. The product sampler packet assembly of claim 10, wherein the assembly burst strength is at least five time greater than the packet burst strength.

12. A packet assembly for distribution, the assembly comprising:

(a) a packet retaining a volume of the product, the packet having a peelable interface, the peelable interface being peelable by a peel force, the packet having a packet burst strength;

(b) a carrier card; and (c) an adhesive standoff bonding the packet to the carrier card, the adhesive standoff defining a bonding pattern between the packet and the carrier card, the adhesive standoff and the bonding pattern selected to provide an assembly burst strength at least twice the packet burst strength.

13. The packet assembly of claim 12, wherein the assembly burst strength is at least five times the packet burst strength.

14. The packet assembly of claim 12, wherein the assembly burst strength is at least ten times the packet burst strength.

15. The packet assembly of claim 12, wherein the adhesive standoff has a hardness greater than 70 Shore A.

16. The packet assembly of claim 12, wherein the adhesive standoff precludes non destructive separation of the packet and the carrier card.

17. A method of distributing a product sample, comprising:

(a) retaining a volume of the product in a packet, the packet having a given burst strength;

(b) bonding the packet to a carrier card with an adhesive standoff, to form and assembly and preclude non destructive separation of the packet from the carrier card, the adhesive standoff configured to provide a burst strength of the assembly at least twice as great as the burst strength of the packet.

18. The method of claim 17, further comprising inserting the assembly into one of a periodical or brochure for distribution.

19. The method of claim 17, further comprising distributing the assembly through a mailing.

20. The method of claim 17, further comprising employing an adhesive having a hardness greater than 60 Shore A.

21. A product sampler packet assembly for distribution, the product sampler packet assembly comprising:

(a) a carrier card;

(b) a sealed packet having a top layer and a bottom layer, the sealed packet retaining a volume of sample material and the sealed packet having a packet burst strength; and (c) an adhesive standoff bonding the sealed packet to the carrier card, the adhesive standoff defining a well sized to receive a volume of sample material, the adhesive standoff having a hardness to provide an assembly burst strength of the packet bonded to the carrier card at least twice as great as the packet burst strength.

22. The product sampler packet assembly of claim 21, wherein a portion of the top layer is releasably bonded to the bottom layer.

23. The product sampler packet assembly of claim 21, wherein the adhesive standoff precludes nondestructive separation of the packet from the carrier card.

* * * * *